US006805611B2

(12) United States Patent
Luk

(10) Patent No.: US 6,805,611 B2
(45) Date of Patent: Oct. 19, 2004

(54) BRASSIERE WITH VISUAL ENHANCEMENT FEATURES

(75) Inventor: Theone Luk, Kwai Chung (HK)

(73) Assignee: Regina Miracle International Limited (HK)

( * ) Notice: Subject to any disclaimer, the term of this patent is extended or adjusted under 35 U.S.C. 154(b) by 0 days.

(21) Appl. No.: 10/349,529

(22) Filed: Jan. 21, 2003

(65) Prior Publication Data

US 2004/0142634 A1 Jul. 22, 2004

(51) Int. Cl.[7] ..... A41C 3/00
(52) U.S. Cl. ..... 450/57; 2/267
(58) Field of Search ..... 450/53–57; 2/267, 2/268

(56) References Cited

U.S. PATENT DOCUMENTS 4,080,416 A * 3/1978 Howard ..... 264/258
4,172,002 A * 10/1979 Gluckin ..... 264/258
4,202,853 A * 5/1980 DiTullio ..... 264/258
4,244,249 A * 1/1981 DiTullio ..... 450/54
4,375,445 A * 3/1983 Cole et al. ..... 264/258
4,481,951 A * 11/1984 Cole et al. ..... 450/54
6,299,505 B1 * 10/2001 Huang ..... 450/57
6,306,006 B1 * 10/2001 Cheng ..... 450/57

* cited by examiner

*Primary Examiner*—Gloria M. Hale
(74) *Attorney, Agent, or Firm*—Ostrolenk, Faber, Gerb & Soffen, LLP

(57) ABSTRACT

A brassiere comprising two molded cups, each having at least two layers of a flexible sheet material defining a breast cup shape. At least one layer includes a plurality of apertures and at least one other layer does not include the plurality of apertures. The colors of the layer without the plurality of apertures may be different than the layer(s) with th plurality of apertures.

21 Claims, 6 Drawing Sheets

BRASSIERE WITH VISUAL ENHANCEMENT FEATURES

FIELD OF THE INVENTION

The present invention relates to a brassiere with visual enhancement features. In particular the present invention relates to a brassiere which includes apertures provided through each of the cups which provide a decorative pattern to the cups of the brassiere.

BACKGROUND

Decorative aspects of a brassiere (bra) are important to woman. Whilst bras have traditionally been used purely as undergarments, some people prefer that any parts of a bra which are visible to another person, are of an appearance which is attractive in nature. In addition, whilst some parts of a bra may not be visible to another person, a person will place some emphasis on the visual appeal that a bra has during a purchasing decision.

Incorporating lace to provide a visually appealing affect to a bra is common. However the provision of lace requires for such to be sewn onto a cup or alternatively be embroidered therewith.

With the advent of bras which are made in a molding process, the object of the manufacturing of such bras is to reduce the cost of manufacturing. Molded bras may be manufactured from one or multiple overlying panels of moldable material. The addition of embroidery can be time consuming. Likewise the stitching of lace onto a cup of a molded bra will add to the cost of the bra. It has hence been desirable to manufacture a bra which includes visually enhancing features which can be provided at a reduced cost.

Accordingly it is an object of the present invention to provide a bra of a molded cup shape form which incorporates visual enhancing apertures in each of the cup shapes of the bra.

It is also an object of the present invention to provide a method of manufacturing a bra which includes cups which have apertures therethrough for the addition of visually enhancing aspects.

BRIEF DESCRIPTION OF THE INVENTION

Accordingly in a first aspect the present invention consists in a brassiere comprising two molded cups which each have at least one layer of a flexible sheet material defining a breast cup shape wherein each molded cup includes a plurality of apertures provided through at least one of said at least one layers.

Preferably each said molded cup has more than one layer of said flexible material and wherein a plurality of said apertures are provided through each of said layers of flexible sheet material.

Preferably said plurality of apertures define a repeating pattern of apertures through said at least one layer of flexible sheet material.

Preferably discrete groups of said plurality of apertures are provided through said at least one layer of flexible sheet material, at least two of said groups defining an identical pattern of apertures through said at least one layer of flexible sheet material.

Preferably the discrete groups of said plurality of patterns are equispaced.

Preferably each molded cup has more than one layer of said flexible sheet material and wherein said apertures are provided through at least the outermost (convex side) of said layers.

Preferably said plurality of apertures are provided in a region of each said molded cups which is adjacent the lower perimeter of said cups.

Preferably said apertures have been formed by the punching of material of said at least one layer of a flexible sheet material.

Preferably said apertures have been formed by the combined ultrasonic heating and punching of material of said at least one layer of a flexible sheet material.

Preferably the material of said molded cup at the perimeter to said apertures is heat welded.

In a second aspect the present invention consists in a method of providing visual enhancements to a brassiere of two molded cups which each has at least one layer of a flexible sheet material defining a breast cup shape said method comprising, whether prior to or after the forming (by molding) of said at least one layer of flexible material into a cup shape, the cutting of a plurality of apertures through at least one of said at least one layers.

Preferably said cutting is achieved by punching.

Preferably cutting is by means for punching die which can be and during cutting is subjected to ultrasonic frequency of 20 kHz.

Preferably at least part of said at least one layer of flexible sheet material is placed between a pressure plate and a punching die comprising of a roller and moved relative to said roller, said roller including a roller surface with upstands to remove the material of said at least one layer of flexible sheet material intermediate thereof and said pressure plate.

Preferably where said cutting is through said molded cups.

Preferably said cutting occurs after said molded cups have been formed.

Preferably said support plate surface rotates about a rotational axis perpendicular to the axis of rotation of said roller.

Preferably said cutting defines a repeating pattern of apertures in said cups.

Preferably said roller rotates through more that 360 degrees so that a repeated punching by at least one upstand of said punching die occurs through said cup in order to define a plurality of apertures though said cup by said at least one upstand.

In a further aspect the present invention consists in a brassiere with two molded cups each having been formed in a molding machine to define breast cups and each including apertures through the cups which have been formed according to the method as herein before defined.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

DETAILED DESCRIPTION OF THE INVENTION

Figure 1:
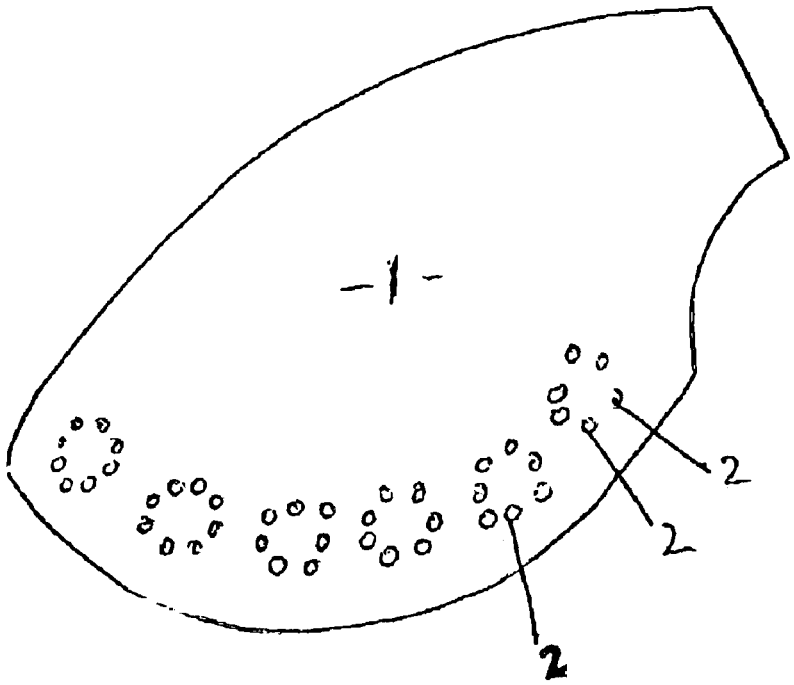
FIG. 1 is a plan view of a molded cup which incorporates circular apertures extending therethrough.
Figure 2:
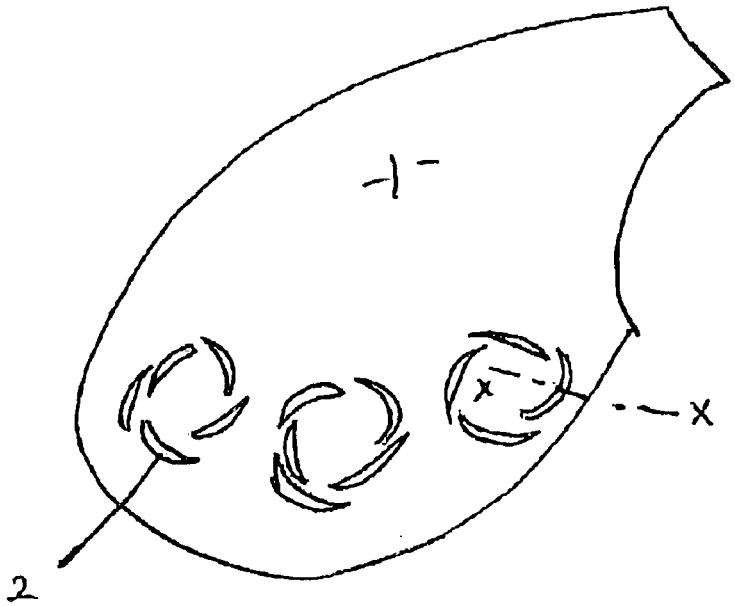
FIG. 2 is a plan view of a cup which also includes apertures therethrough which are of a non circular shape.
Figure 4:
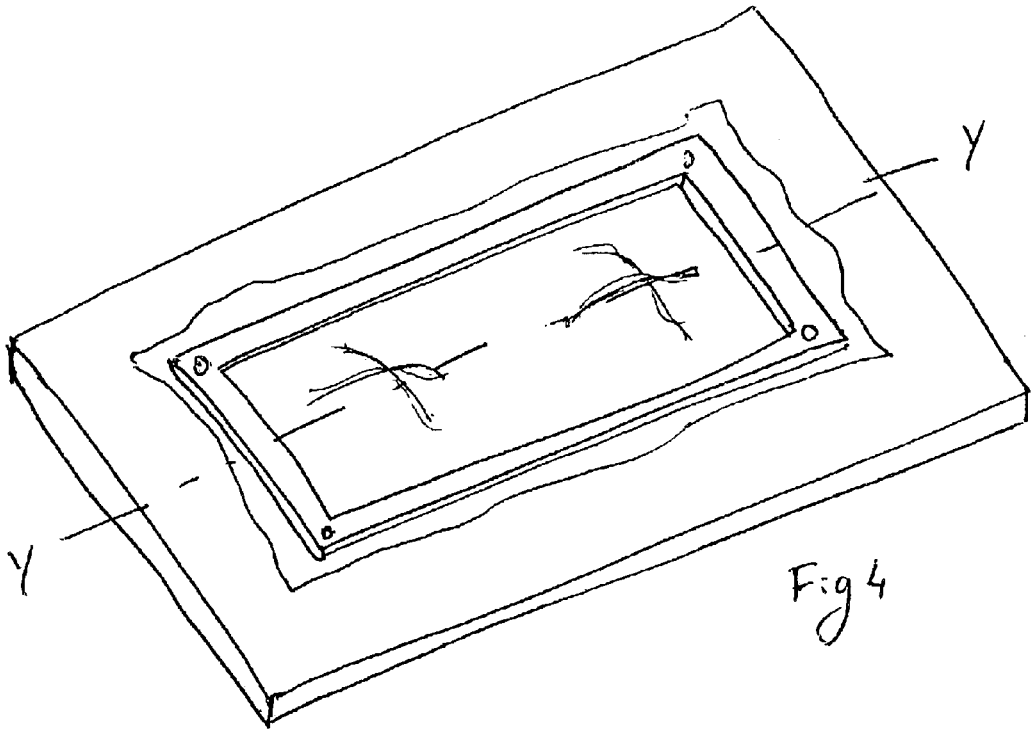
FIG. 4 illustrates the sheet of material of FIG. 3 being fastened to a male molding plate.
Figure 5:
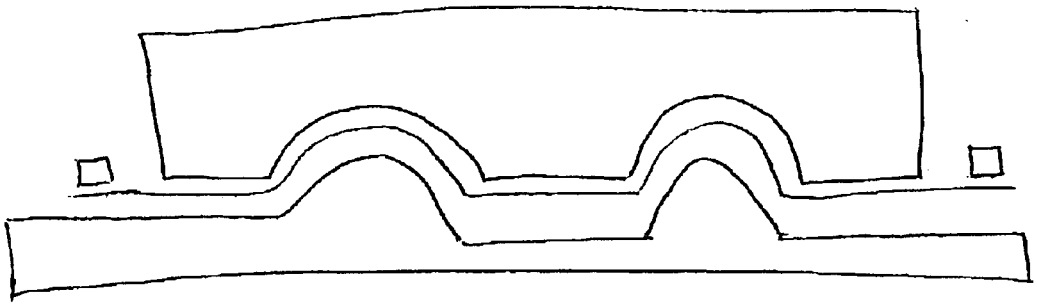
FIG. 5 is a exploded and sectional view through section YY of FIG. 4 and wherein a female molding member is introduced for molding of two cups.

With reference to FIGS. 1 and 2 there is shown a breast cup for incorporation with other components to define a bra. This cup is of a kind which has been molded into a three dimensional shape by the use of molding apparatus as for example shown in FIGS. 4 and 5. The breast cup may consist of one layer of moldable material or alternatively may consist of a plurality of layers each preferably being of a moldable nature. Where the breast cup consists of more than one layer, each layer preferably substantially overlies the other(s) to define a breast cup of multiple layers of coextensive material. The layers may include a core foam layer external of which are fabric outer and inner layers (convex and concave side layers). The external layers may be of a fabric material and are preferably of a plastics based fabric material such as for example a polyester or nylon or the like. The core foam material is also preferably of a plastics based material for reasons which will later become apparent.

The breast cup 1 has a plurality of apertures 2 provided through at least one of the layers of the breast cup construction. The said layer is at least the outermost layer. In the most preferred form the apertures 2 extend through all of the layers (or where there is only one layer, through that one layer), and hence through the cup.

The apertures are provided preferably through all of the layers of the cup. When the bra is being worn, it will hence be possible to see through the apertures and see the skin of the breast.

In the most preferred form a plurality of apertures are provided to define a pattern in a region of the cup form. With reference to FIG. 1, it can be seen that a plurality of apertures are grouped together to define a pattern of apertures. With reference to FIG. 1 it can be seen that a plurality of circular patterns defined by the plurality of apertures can be provided. With reference to FIG. 2, circular patterns defined by more elongate apertures are shown. In the most preferred form, the apertures provided through the cup are at or towards the lower region of the cup however such patterns may alternatively be provided along the upper regions of the cup or over the entire cup.

In the most preferred form, the left and right hand side cups of a bra (since they are mirror images of each other), will also provide the apertures each as a mirror image to that of the other cup.

Figure 3:
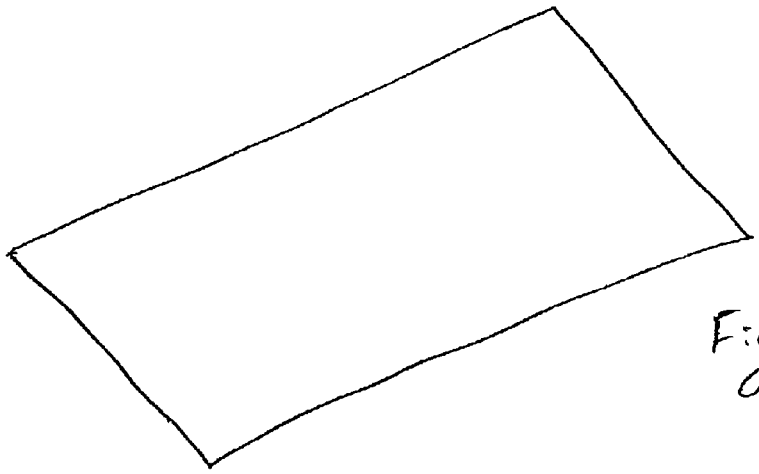
FIG. 3 is a perspective view of a sheet(s) of flexible material used for the manufacturing of the cups of the brassiere of the present invention.

The apertures provided through each of the cups are preferably provided after the cups have been defined to a three dimensional cup form. Alternatively however the sheet material as shown for example in FIG. 3 may be subject to processing to define apertures therethrough prior to being formed to a three dimensional cup form. So that the position of the apertures can be reasonably accurately defined and so that the apertures are provided to be of a shape which is controllable (which may otherwise not occur if further stretching and molding of the material occurs after the apertures have been provided) the cups are subjected to cutting to define the apertures.

With the selection of plastics based materials for the breast cup, the apertures can be formed through the breast cup or at least through one of the layers of the breast cup by the use of heating to melt the material and by punching pressure. By heating and by applying pressure (punching) pressure by a punching tool the layers of material can be removed from the cup to define the apertures. In the most preferred form, heating of the material during cutting is achieved by ultrasonic frequencies.

Figure 6:
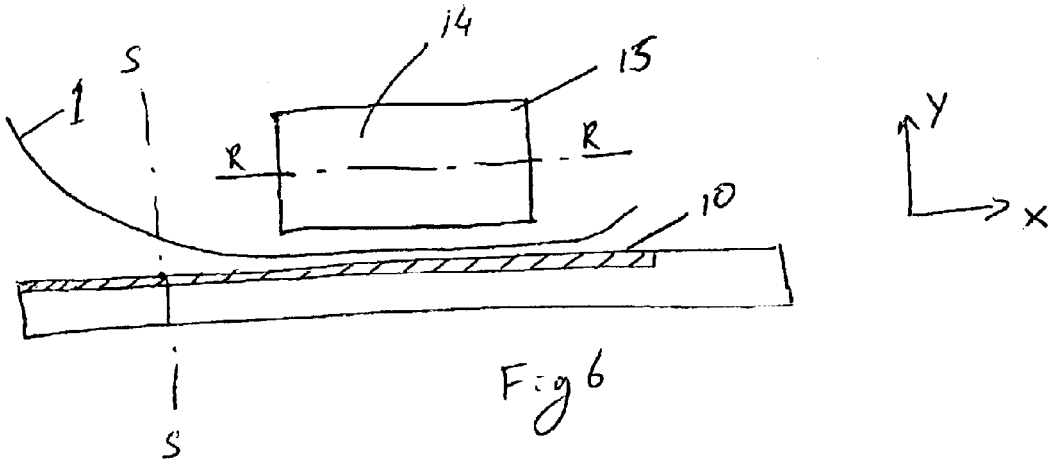
FIG. 6 is a side view of an arrangement for introducing the apertures into the molded cup shape and includes a roller provided to press against the cup and onto a base plate for the cutting of the apertures from the cup.
Figure 10:
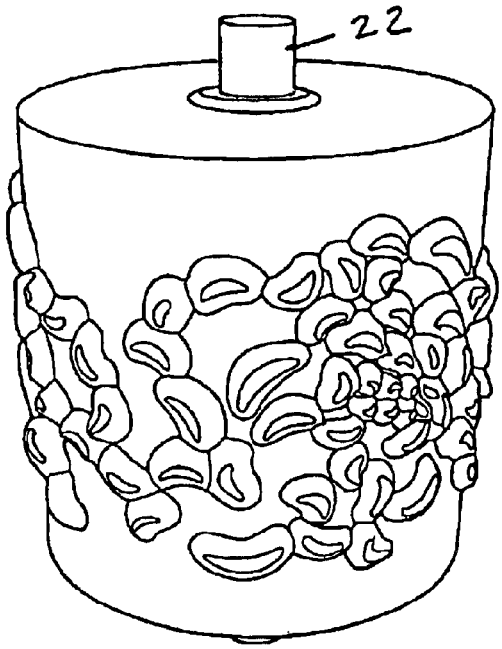
FIG. 10 is a perspective view of the roller which may be used for providing the apertures in the molded cups.

With reference to FIG. 10 there is shown a pressure roller which includes a cylindrical surface 15 having upstands 22 which are of a form which will define the apertures through breast cups. The upstands 22 will press against a base plate 10 as shown in FIG. 6 intermediate of which the breast cup will be positioned. The upstands 22 will both punch (as a result of pressure) and melt (as a result of the ultrasonic frequencies) the material of the cup at least at its perimeter of the upstands and thereby remove material of the cup where the are to be formed.

Figure 7:
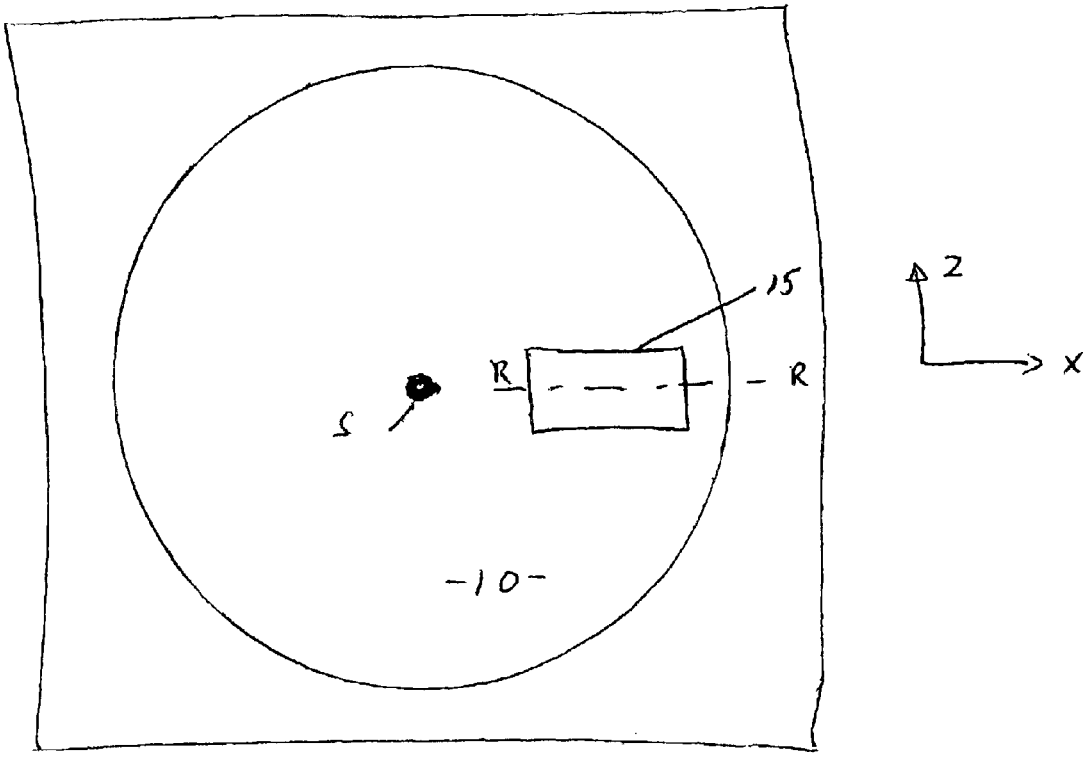
FIG. 7 is a plan view of FIG. 6.

With reference to FIGS. 6 and 7 (but where up stands are not shown on e roller) the cup material can run passed the roller 14 supported by the base plate 10. Pressure between the roller and base plate will trap the cup form against the roller. The cup form will move relative to the roller so as to rotate the roller about its axis RR. The roller will include a series of upstands which each will provide at least one aperture through the breast cup construction. The roller may rotate through more than 360° of rotation during the passing of a cup and each upstand may hence provide a plurality of apertures through the cup. The region of the cup which passes between the roller and the base plate will flatten during the punching of the apertures and this can for example be seen in FIG. 6.

To aid in the advancement of the cup relative to the roller, the base plate 10 is preferably moveable relative to the roller. The base plate 10 may for example be a circular plate rotatable (whether driven or passive) about axis SS and with which the cup form will move during its movement relative to the roller.

The advantage that is provided by a combined punching and ultrasonic cutting process is that the material of the cup immediately about the apertures will be heat sealed thereby preventing or at least reducing the possibility of the material tearing or fraying.

Figure 8:
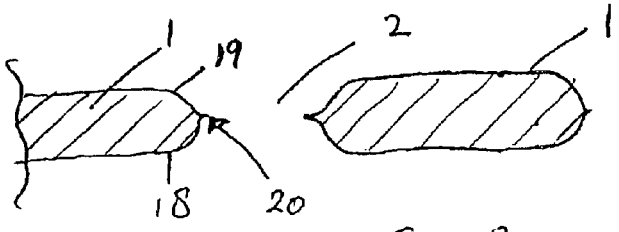
FIG. 8 is a sectional view through section XX of FIG. 2.
Figure 11:
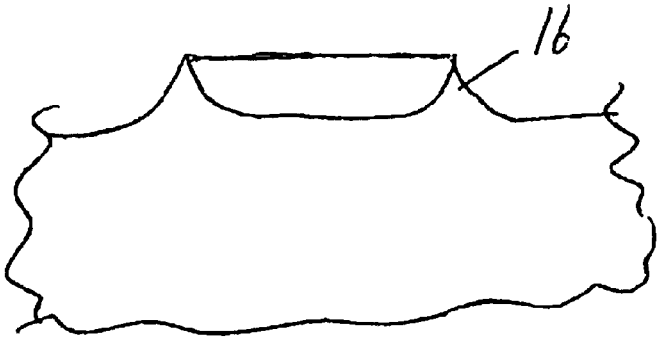
FIG. 11 is a cross sectional view through one upstand of the roller for providing an aperture through the cup.
Figure 12:
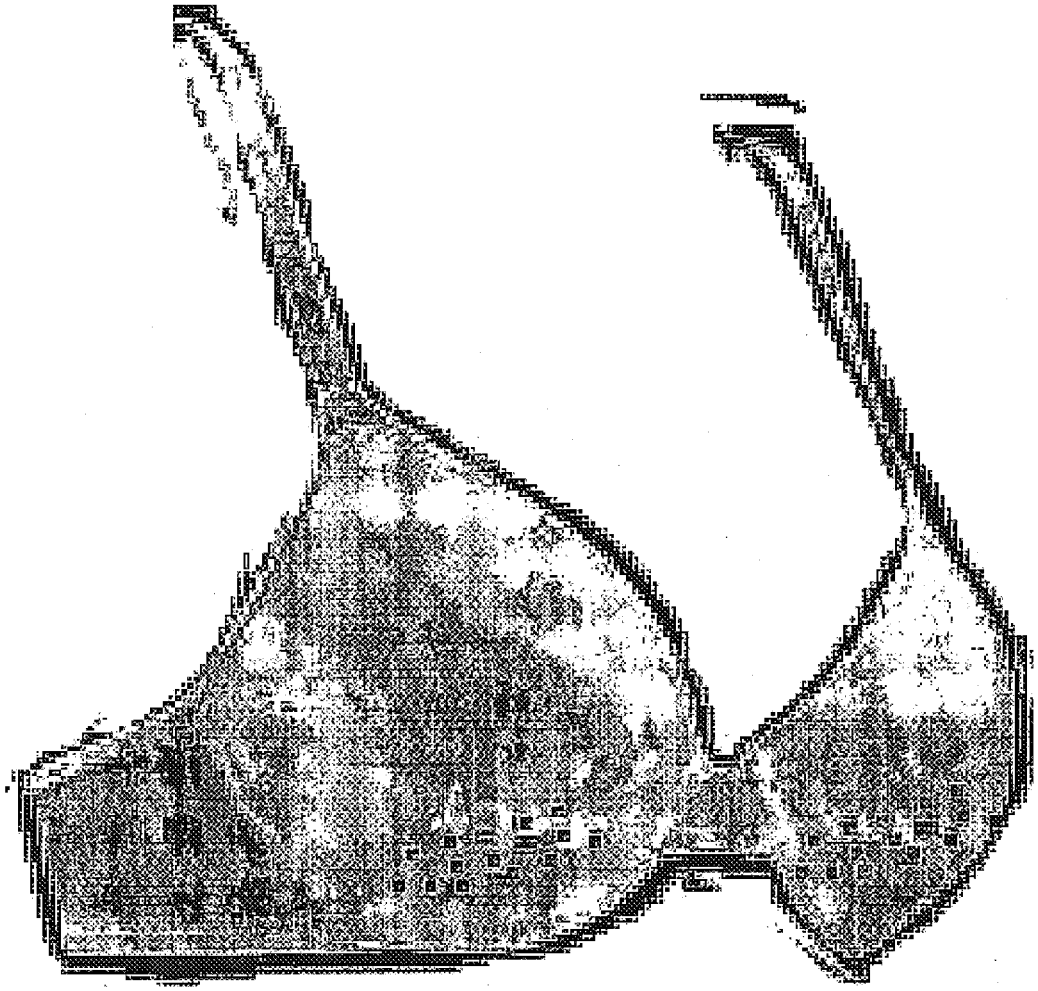
FIG. 12 is a perspective view of a brassiere in accordance with the present invention.

With reference to FIG. 8 and FIG. 11, the edge profile of at least on upstand 16 has a radius rather than being a sharp angle upstand. This will ensure that a pinching of the material about each of the apertures occurs and that the opposite facing surfaces 18 and 19 of the breast cup are brought together at a central region 20 (FIG. 8). This will hence also provide a substantially complimentary shaped radius edge to each aperture (when viewed in cross section as shown for example in FIG. 8) which will reduce the possibility of fraying.

Figure 9:
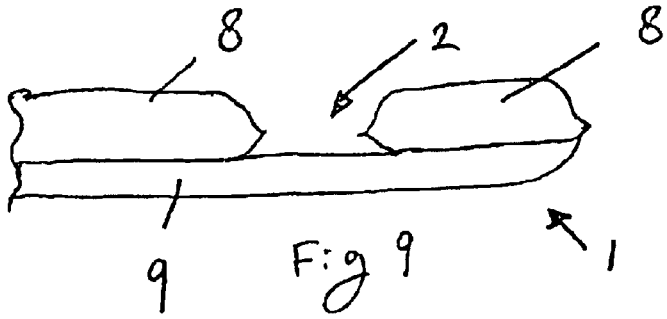
FIG. 9 is a sectional view through section XX of FIG. 2 but wherein an additional sheet of flexible material has been provided so that the aperture provided in one of the sheets of flexible material of the cup shape is a blind aperture.

With reference to FIG. 9 there is shown a first layer 8 of the cup through which a first plurality of apertures 2 has been provided and a second layer 9 through which no apertures have been provided which are aligned with the apertures in the first layer. The first layer 8 (which is the outer or convex side layer of the cup) may be punched by the method as defined hereabove and prior to the further layer 9 being adhered or molded thereto. In this manner, an aperture through at least one of the layers of the cup can be provide. With the selection of particular colours a sufficient contrast between the layer 8 and layer 9 can be provided so that a novel colouring effect to the apertures provided through the 1 layer 8 by the layer 9 can result. In this manner the apertures in the first layer are blind apertures and will not allow a person to see through to the skin of the person wearing the bra but instead see through the layer 9 which may be of a different colour to the layer 8 thereby creating a similar effect.

What is claimed is:

1. A brassiere comprising two molded cups, each having at least two layers of a flexible sheet material defining a breast cup shape, wherein at least one of said at least two layers is an outside layer of the cup and includes a plurality of apertures provided through said at least one of said at least two layers and at least one other of said at least two layers does not include a plurality of apertures aligned with said plurality of apertures in said at least one layer.

2. A brassiere as claimed in claim 1 wherein each said molded cup has at least three layers of said flexible sheet material and wherein a plurality of said apertures are provided through at least one of said at least three layers of said flexible sheet material and at least one other of said at least three layers does not include a plurality of apertures aligned with said plurality of apertures in said at least one layer.

3. A brassiere as claimed in claim 1 wherein said plurality of apertures define a repeating pattern of apertures through said at least one of said at least two layers of flexible sheet material.

4. A brassiere as claimed in claim 1 wherein said plurality of apertures are grouped into discrete groups of said plurality of apertures through said at least one of said at least two layers of flexible sheet material at least two of said groups defining an identical pattern of said apertures.

5. A brassiere as claimed in claim 4 wherein said discrete groups of said plurality of patterns are equispaced.

6. A brassiere as claimed in claim 1 wherein each said molded cup has an outermost convex side and wherein said apertures are provided through at least said outermost convex side of said at least one of said at least two layers.

7. A brassiere as claimed in claim 1 wherein each said molded cup has a lower perimeter and said plurality of apertures are provided in a region of each said molded cups which is adjacent said lower perimeter of said cups.

8. A brassiere as claimed in claim 1 wherein said apertures have been formed by punching of material of said at least one of said at least two layers of a flexible sheet material.

9. A brassiere as claimed in claim 8 wherein said apertures have been formed by combined ultrasonic heating and punching of material of said at least one of said at least two layers of a flexible sheet material.

10. A brassiere as claimed in claim 1 wherein said material of said molded cup is heat welded adjacent said apertures.

11. A method of providing visual enhancements o a brassiere of two molded cups, comprising molding each said cup of at least two layers of a flexible sheet material for defining a breast cup shape, either prior to or after molding of said at least two layer of flexible material into a cup shape, cutting a plurality of apertures through at least outer one of said at least two layers while not forming apertures in at least one other of said at least two layers, so that no apertures in said at least one other layer would be aligned with said plurality of apertures in said at least one layer.

12. A method as claimed in claim 11 wherein said cutting comprises punching.

13. A method as claimed in claim 10 wherein said cutting is applying a punching die which is subjected t ultrasonic frequency of 20 kHz.

14. A method as claimed in claim 11 wherein said cutting comprises placing at least part of said at least one layer of said at least two layer of flexible sheet material between a pressure plate and a punching die comprising a roller and moving said one layer relative to said roller, wherein said roller includes a roller surface with upstands to remove the material of said at least one layer of said at least two layers of flexible sheet material intermediate said roller surface and said pressure plate.

15. A method as claimed in claim 11, further comprising coloring said at least one other of aid at least two layers different from said at least one of said at least two layers.

16. A method as claimed in claim 11 wherein said cutting is performed after said molded cups have been formed.

17. A method as claimed in claim 14 wherein said plate has a surface, and said plate surface rotates about a rotational axis perpendicular to the axis of rotation of said roller.

18. A method as claimed in claim 11 wherein said cutting is performed to define a repeating pattern of apertures in said cups.

19. A method as claimed in claim 14 wherein said upstands are so positioned on said roller surface and said roller rotates through more that 360 degrees during said cutting that a repeated punching of said at least one layer by at least one said upstand of said punching die occurs to define a plurality of apertures by said at least one upstand.

20. A brassiere with two molded cups each having been formed in a molding machine to define breast cups and each including apertures which have been formed according to the method defined in claim 11.

21. A brassiere as claimed in claim 1, wherein said at least one other of said at least two layers has a color different from said at least one of said at least two layers.

* * * * *